US005697101A

United States Patent [19]

Aldridge

[11] Patent Number: 5,697,101

[45] Date of Patent: Dec. 16, 1997

[54] PROTECTIVE GARMENT WITH APERTURED CLOSED-CELL FOAM LINER

[75] Inventor: Donald Aldridge, New Carlisle, Ohio

[73] Assignee: Lion Apparel, Inc., Dayton, Ohio

[21] Appl. No.: 596,702

[22] Filed: Feb. 5, 1996

Related U.S. Application Data

[63] Continuation of Ser. No. 119,474, Sep. 10, 1993, abandoned.

[51] Int. Cl.[6] ..... A41D 13/00

[52] U.S. Cl. ..... 2/81; 2/97; 2/458

[58] Field of Search ..... 2/2, 2.11, 2.14, 2/2.15, 2.16, 69, 79, 81, 82, 85, 86, 87, 93, 97, 159, 161.6, 164, 272, 227, 5, 458

[56] References Cited

U.S. PATENT DOCUMENTS

| | | | |
|---|---|---|---|
| 2,570,182 | 10/1951 | Daly et al. | 260/2.5 |
| 2,976,539 | 3/1961 | Brown | 2/2 |
| 2,981,954 | 5/1961 | Garbellano | 2/2.1 |
| 4,034,417 | 7/1977 | Ellis | 2/81 |
| 4,495,661 | 1/1985 | Kamat | 2/97 |
| 4,502,153 | 3/1985 | Lapedes et al. | 2/81 |
| 4,583,247 | 4/1986 | Fingerhut et al. | 2/69 |
| 4,604,759 | 8/1986 | Bowman et al. | 2/81 |
| 4,685,155 | 8/1987 | Fingerhut et al. | 2/81 |
| 4,805,244 | 2/1989 | Scott | 2/272 |
| 4,843,646 | 7/1989 | Grilliot et al. | 2/69 |
| 4,860,382 | 8/1989 | Markwell | 2/82 |
| 4,922,552 | 5/1990 | Grilliot et al. | 2/93 |
| 4,994,317 | 2/1991 | Dugan et al. | 428/246 |
| 4,999,850 | 3/1991 | Grilliot et al. | 2/97 |
| 5,001,781 | 3/1991 | Grilliot et al. | 2/69 |
| 5,021,280 | 6/1991 | Farnworth et al. | 428/102 |
| 5,044,031 | 9/1991 | Sherwood et al. | 5/481 |
| 5,054,125 | 10/1991 | Snedeker | 2/81 |
| 5,136,723 | 8/1992 | Aldridge et al. | 2/81 |

OTHER PUBLICATIONS

Mustang Industries Marine Wear Brochure, 1986.
Product Information, Mustang Aviation Coverall, 1983.
Mustang Manufacturing Inc. Aviation Coverall, 1992.
Patagonia, Inc. Impact Tights, 1993.

*Primary Examiner*—Diana Biefeld
*Attorney, Agent, or Firm*—Thompson Hine & Flory LLP

[57] ABSTRACT

A protective garment having an outer shell and a thermal liner having a layer of apertured, closed-cell foam material. In a preferred embodiment, the foam material is fire retardant and the layer is bonded to the outer shell, and the garment includes a moisture barrier layer positioned between the foam liner and the wearer of the garment. The closed-cell foam liner is non-moisture absorbent and provides high thermal insulation for its weight and thickness in comparison to prior art thermal liners, so that a relatively thin layer of foam material may be used. Accordingly, the overall weight of the garment is minimized, as is the movement-restricting effect of the liner. The non-absorbency of the foam liner allows the liner to be positioned between the moisture barrier and the outer shell of the garment so that the liner does not restrict flow of perspiration moisture vapor from the wearer to the moisture barrier. The apertures formed in the foam liner promote transport through the liner of moisture vapor from the wearer which passes through the moisture barrier. Such closed-cell foam material may be used both as a continuous thermal barrier extending throughout the garment and/or in selected areas which require additional padding or thermal resistance.

23 Claims, 2 Drawing Sheets

PROTECTIVE GARMENT WITH APERTURED CLOSED-CELL FOAM LINER

This is a continuation of application Ser. No. 08/119,474, filed Sep. 10, 1993, now abandoned.

BACKGROUND OF THE INVENTION

The present invention relates to garments which protect the wearer from hazardous environmental conditions and, more particularly, to garments which provide the wearer with protection from external heat and moisture.

Protective garments are designed to shield the wearer from a variety of environmental hazards, and firefighter garments are representative of such garments. A typical firefighter garment includes an outer shell and an inner liner including a moisture barrier and a thermal barrier. The outer shell consists of a fabric of an aramid fiber such as NOMEX, KEVLAR (both registered trademarks of E.I. DuPont de Nemours & Co., Inc.), or a NOMEX/KEVLAR blend which provides resistance to abrasion and some thermal resistance.

The thermal barrier may comprise a layer of NOMEX and KEVLAR fibers, or a batting of such fibers, often quilted to a lightweight NOMEX face cloth. The batting of the thermal barrier traps air and possesses sufficient loft to provide the necessary thermal resistance, and the face cloth provides resistance to abrasion of the thermal liner by the wearer.

Moisture resistance is provided by a membrane of GORE-TEX (a registered trademark of W. L. Gore & Associates, Inc.) material bonded adhesively to a substrate of a NOMEX and KEVLAR blend. The GORE-TEX material has microscopic openings which permit the transport of moisture vapor, thereby allowing perspiration moisture vapor of the wearer to escape outwardly, but are sufficiently small to prevent liquid moisture from passing through to the wearer.

The aforementioned ensemble possesses acceptable abrasion, thermal and moisture resistance properties, but there exist inherent disadvantages with such a garment. However, the typical arrangement of the components within the garment is such that the moisture barrier layer is positioned between the thermal liner and the outer shell. This is necessary to prevent the batting material of the thermal liner from absorbing moisture from the ambient, which would add to the overall weight of the garment and possibly reduce its loft and thermal resistance characteristics.

The disadvantage with such an arrangement is that the presence of the thermal liner between the moisture barrier and the wearer acts as a barrier which inhibits the free flow of perspiration moisture vapor from the wearer to and through the moisture barrier layer. Consequently, in high activity or stress situations, perspiration moisture vapor generated by the wearer may become trapped within the thermal liner, thus wetting the thermal liner, which adds weight to the garment and lowers the TPP (Thermal Protection Property) of the thermal liner.

Another disadvantage with such prior art garments is that the additional bulk and loft provided by such fabric thermal liners inhibits the freedom of movement of the wearer, producing a "hobbling effect," and requires the use of a face cloth, which increases the cost of the garment. The former disadvantage increases the stress imposed on the wearer in a situation requiring high activity, and accelerates the onset of fatigue.

Another type of firefighter garment, disclosed in Aldridge et al. U.S. Pat. No. 5,136,723, utilizes a thermal liner consisting essentially of a layer or layers of open mesh fabric. In addition to trapping a layer of air between the wearer and the shell of that garment, the open apertures promote heat and perspiration vapor transfer from the wearer's body. However, since such mesh fabric absorbs liquid moisture, it is preferable to place such a thermal liner inside of the moisture barrier; that is, between the wearer and the moisture barrier. Consequently, such a mesh barrier still impedes the transport of moisture vapor somewhat.

Accordingly, there is a need for a protective garment in which the transport of moisture vapor generated by the perspiration of the wearer is permitted to flow freely to and through the moisture barrier, which is relatively light in weight, yet provides adequate thermal protection, and which minimizes the restriction of movement and hobbling effect characteristic of insulated garments.

SUMMARY OF THE INVENTION

The present invention is a protective garment having relatively light weight, relatively high resistance to water absorption and relatively high moisture vapor transport characteristics when compared to conventional firefighter garments. The garment of the present invention comprises an outer shell, a thermal liner and a moisture barrier, in which the thermal liner includes a layer of apertured closed-cell foam material. The closed-cell foam layer when attached to a flame retardant substrate, such as an aramid material, provides sufficient thermal insulation to meet or exceed N.F.P.A. (National Fire Protection Association) requirements, yet it is lighter in weight than conventional batting or other fabric-type thermal barriers of similar insulation value.

Two characteristics of closed-cell foam provide these advantages. First, the closed-cell structure of the foam provides superior insulating properties when compared to air permeable fibers of prior art garment insulation on weight and thickness bases. Second, a sheet of the closed-cell foam of the present invention is more dimensionally stable and uniform in thickness than a comparable sheet of prior art fiber insulation, so that a sheet of the closed-cell foam can be made thinner and still, when attached to a flame retardant substrate, such as an aramid material, meet the minimum overall N.F.P.A. requirements for a garment. Since the insulation layer can be made thinner, the overall size and bulk of the garment is reduced significantly, which reduces the amount of material required for the garment, thereby reducing the overall cost of the garment, and minimizes the hobbling effect of such insulation, which reduces stress and fatigue and facilitates donning and doffing the garment.

In prior art protective garments, it is necessary to position the thermal barrier between the moisture barrier and the wearer so that the moisture barrier protects the thermal barrier from becoming saturated with liquid moisture seeping through the outer shell. However, in that position, the thermal barrier hinders the flow of moisture vapor from the wearer through the moisture barrier membrane, and often becomes saturated with perspiration moisture from the wearer itself.

In contrast, the closed-cell foam thermal liner of the present invention does not absorb water and can be placed outside the moisture barrier, between the moisture barrier and the outer shell. With this arrangement of the layers, the moisture barrier membrane is positioned as close as possible to the wearer to maximize the flow of moisture vapor from the wearer through the moisture barrier. Since the thermal liner is on the opposite side of the moisture barrier from the wearer, the chance of the wearer being scalded by a heated thermal liner saturated with moisture is significantly reduced. Such an occurrence is further reduced since the closed-cell foam layer of the thermal liner of the present invention does not readily absorb water.

Further, the moisture barrier substrate, typically a woven blend of NOMEX and KEVLAR, is against the wearer and thereby eliminates the need for a separate face cloth, which is needed to protect the thermal liner with prior art garments in which the thermal liner is inside the moisture barrier. This further reduces the overall weight and cost of the garment.

Consequently, the thermal liner of the garment of the present invention functions similarly to the mesh thermal liner of Aldridge et al. U.S. Pat. No. 5,136,723 in that the apertures of the closed-cell foam liner of the present invention promote the transport of perspiration moisture vapor outwardly from the wearer. Furthermore, like the mesh apertures of the garment of the Aldridge et al. patent, the apertures in the closed-cell foam can perform an insulating function, provided that the apertures are sized sufficiently small. However, the use of closed-cell foam as the matrix for the apertures of the thermal liner of the present invention not only provides improved insulation values, but enables the liner to be positioned outside of the moisture barrier.

In a preferred embodiment of the invention, the foam thermal liner is bonded to the outer shell by an adhesive, and the moisture barrier is separate from the laminate formed by the outer shell and the foam thermal liner. Accordingly, the outer shell acts as a supportive substrate for the foam liner so that the combination of the shell and liner meet the N.F.P.A. requirements for tear strength.

In an alternate embodiment of the invention, the foam thermal liner is separate from both the moisture barrier and shell and is bonded by an adhesive to a fabric substrate. With this embodiment, all the layers of the ensemble can be separated to facilitate repair or maintenance.

In another embodiment, a garment having an apertured closed-cell foam liner is augmented with patches of closed-cell foam material, which can be either apertured or non-apertured, positioned between the outer shell and the liner in strategic locations, such as the elbow or shoulder yoke of the garment. Such pads or patches increase the thermal resistance in such areas in response to external pressure, as well as add resiliency to those areas in response to increased loading, as from the pads and straps of SCBA Equipment. Alternately, such padding can be applied externally of the outer shell by pads covered with a patch of leather or aramid shell material.

Accordingly, it is an object of the present invention to provide a protective garment with a thermal liner including a layer of apertured closed-cell foam material which provides thermal resistance and moisture resistance; a protective garment in which the liner is relatively lightweight and resilient, yet possesses the necessary TPP ratings to meet N.F.P.A. standards; a protective garment having an apertured closed-cell foam liner which is relatively simple to construct, launder and maintain; a protective garment in which the thermal liner is relatively thin and uniform, thereby minimizing the bulk such a layer adds to a garment, which reduces the hobbling effect of such a garment and the cost of additional material; and a protective garment having a thermal liner and moisture barrier in which the apertured foam thermal barrier can be placed outside of the moisture barrier, thereby enhancing the transport of moisture vapor from the wearer outwardly to the outer shell and eliminating the need for a layer of face cloth material.

Other objects and advantages of the present invention will be apparent from the following description, the accompanying drawings and the appended claims.

DETAILED DESCRIPTION

Figure 1:
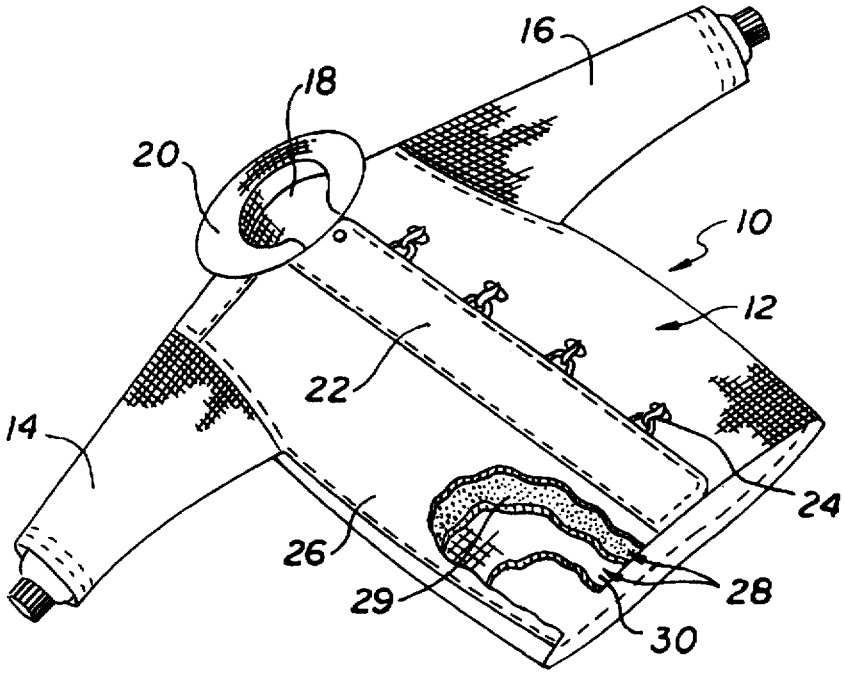
FIG. 1 is a somewhat schematic, perspective view of a firefighter garment incorporating a preferred embodiment of the present invention.

As shown in FIG. 1, the protective garment of the present invention is embodied in a protective garment in the form of a firefighter garment, generally designated 10, which is a firefighter coat having a body portion 12, sleeves 14, 16, a neck opening 18, a collar 20 surrounding the neck opening, and a front closure, generally designated 22. The front closure 22 is of conventional design and may comprise snaps or, alternately, strips of hook and loop fastener material (not shown) in combination with mechanical locking means such as hook and "D" combinations 24.

Figure 2A:
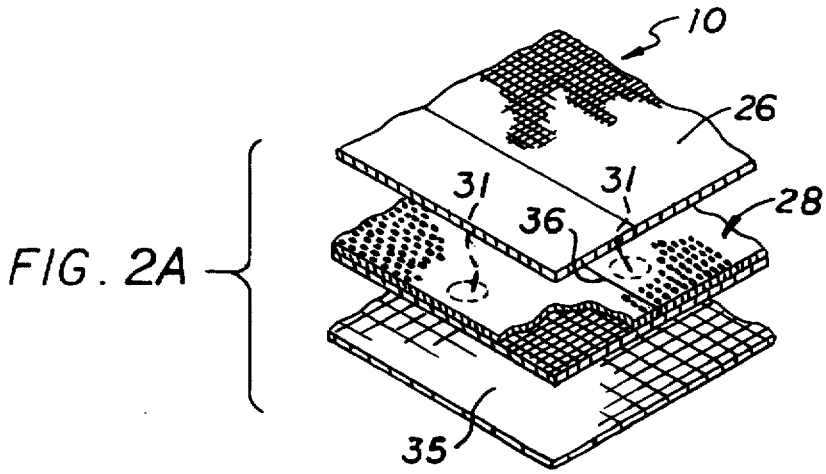
FIG. 2 is an exploded, perspective detail of the garment of FIG. 1 showing the layers of material comprising the ensemble.
Figure 2:
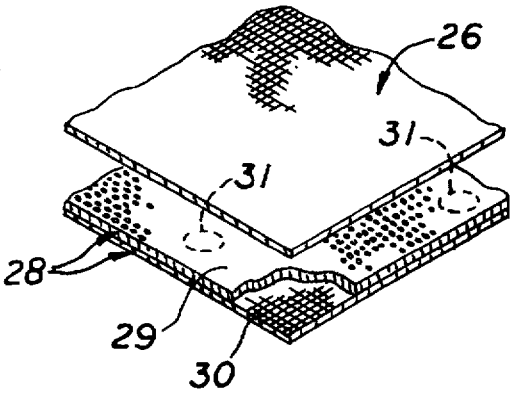

As shown in FIGS. 1 and 2, the garment 10 includes an outer shell, generally designated 26, of an aramid material such as NOMEX, which covers the entire garment. Extending throughout the garment 10 is an inner moisture barrier layer 28. The moisture barrier layer 28 preferably consists of a membrane 29 of GORE-TEX material attached adhesively to a fabric substrate 30 of NOMEX and KEVLAR.

A thermal liner, generally designated 31, extends throughout the garment and consists of a layer 32 of closed-cell foam material which is provided with a multiplicity of apertures 33. The apertures 33 preferably are about 1 mm in diameter and are arranged in a pattern of about 84 apertures per square inch. However, other hole sizes and hole densities may be employed without departing from that scope and intent of the invention. The foam layer 32 of the thermal liner 31 preferably is between 3/32 and 1/8 inches thick and is made of a fire-retardant material, such as ENSOLITE styles IV1, IV2, IV3, IV4, IV5, GIC or IVC, manufactured by Ensolite, Inc. of Mishawaka, Ind. A characteristic inherent in such fire-retardant materials is that when attached to a flame retardant substrate, such as an aramid material, the combinations resists melt, dripping and separating when exposed to a temperature of 500° F. for at least 5 minutes.

The foam liner 31 is positioned between the moisture barrier layer 28 and the shell 26, and is bonded by a suitable adhesive to the shell, preferably by a pattern of "dots" 34 of adhesive so that the apertures 33 generally are not blocked. The dots 34 are shown larger than actual size in the figures for clarity, and are actually about 1 mm in diameter.

Figure 3:
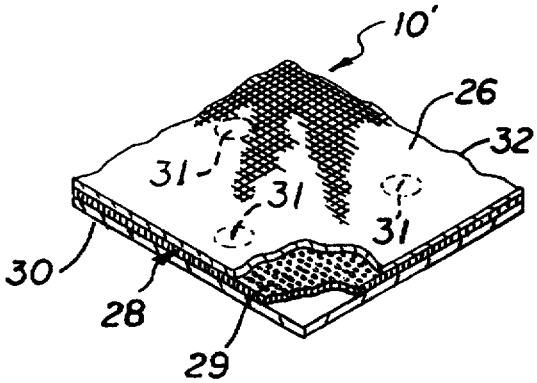
FIG. 3 is an exploded, perspective detail similar to FIG. 2, but of an alternate embodiment of the invention.

An alternative embodiment of the invention is shown in FIG. 3. With the garment 10', the thermal liner 31' is positioned between shell 26' and moisture barrier 28, but is unattached to the shell. With this embodiment, the thermal liner 31' consists of an apertured foam layer 32' bonded by dots 34 of a suitable adhesive to a substrate 36 of a woven NOMEX material to provide dimensional stability and to meet the tear strength requirements of N.F.P.A. regulations. A preferred adhesive consists of the same adhesive used to bond the membrane 29 to the substrate 30 of the moisture barrier 28. Consequently, the thermal liner 31' is separable from the outer shell 26' and moisture barrier 28 for replacement, maintenance or laundering.

With the garments 10, 10' of FIGS. 2 and 3, respectively, by positioning the thermal liners 31, 31' in between the moisture barriers 28 and outer shells 26, 26', the thermal liners no longer obstruct the free flow of perspiration moisture vapor, generated by a wearer during strenuous activity, through the moisture barrier 28. Consequently, the build-up of perspiration moisture within the garment is significantly reduced. This arrangement is made possible by the inherent properties of the closed-cell foam liner 31, 31'. Such a garment will possess advantages over traditional firefighter garments in that the closed-cell foam material is lighter in weight than a traditional thermal liner of similar TPP ratings.

Another advantage with such an arrangement is that the closed-cell foam material does not absorb water, so that the overall ensemble does not get as heavy in conditions of high water saturation, and therefore reduces stress on the wearer since the weight is reduced. Furthermore, the TPP rating will remain more constant than prior art thermal liners, regardless of the amount of water saturation of the garment, since the thermal liner resists absorbing water.

The method of manufacturing the garment 10 of the present invention is similar to conventional methods. However, the outer shell is made of a laminate of outer shell material and closed-cell, apertured foam which is prepared in roll form, and the patterns are cut and sewn together to make the combination outer shell and thermal liner. The moisture barrier is separately made by laminating a semi-permeable membrane to a fabric substrate, and is inserted into the outer shell and secured at the peripheries of the outer shell and moisture barrier by snaps, strips of hook and loop material, or permanently by stitching.

In the embodiment of FIG. 3, the closed-cell foam layer is first bonded to a fabric substrate and supplied in roll form, and the patterns of liner are cut from the roll, stitched into the desired garment shape and inserted into a conventional outer shell. The moisture barrier laminate of membrane and substrate is then inserted into the garment. The separate layers are attached to each other by snaps, strips of hook and loop material or permanently by stitching.

Figure 4:
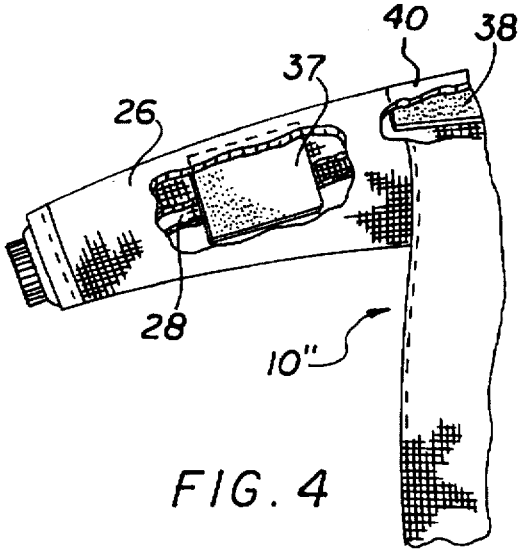
FIG. 4 is a detail of the garment of FIG. 1, but modified to include additional padding in strategic areas.
Figure 6:
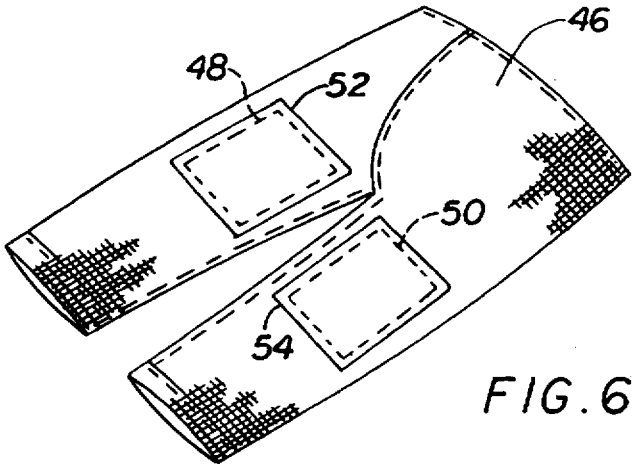
FIG. 6 is a schematic, perspective view of a firefighter pant having reinforcing pads according to the present invention.
Figure 1:
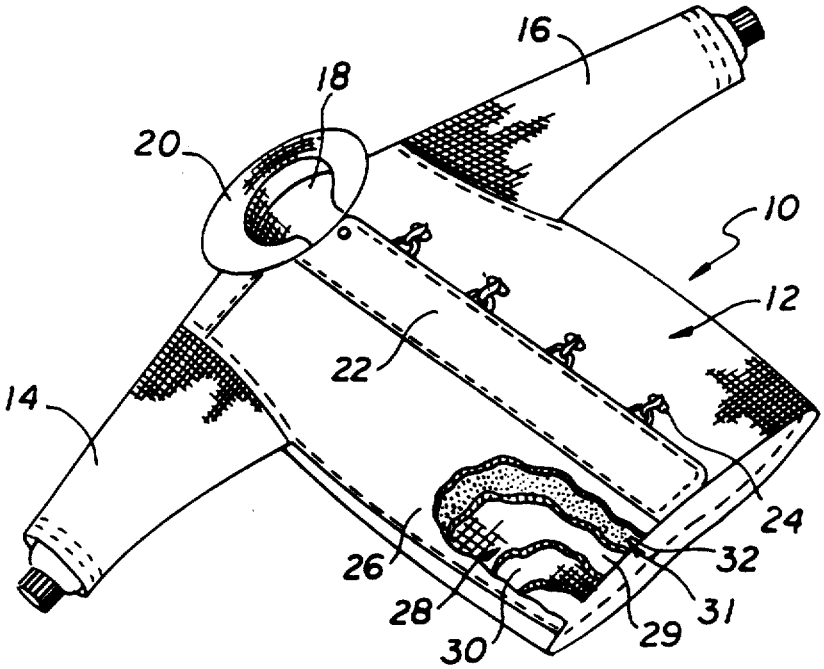
Figure 2:
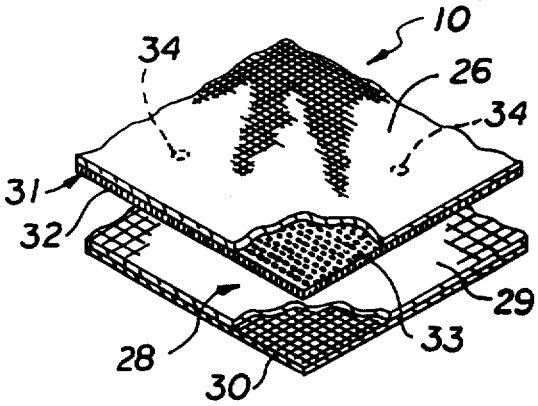
Figure 3:
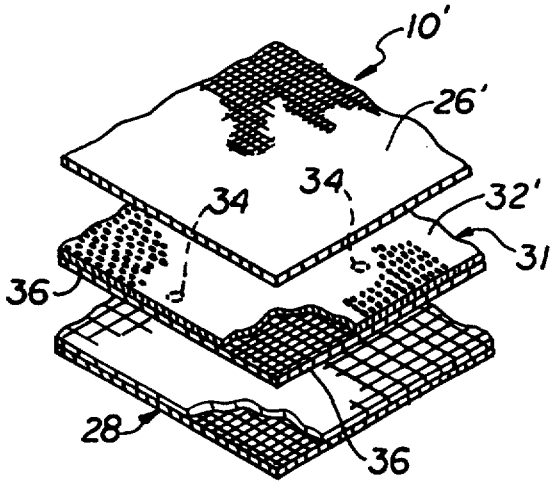
Figure 4:
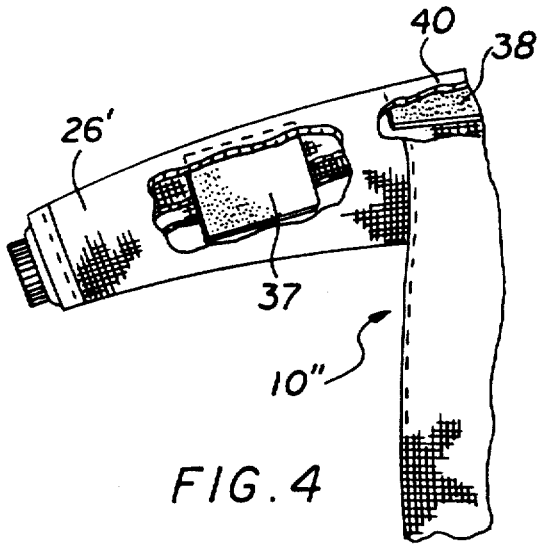
Figure 5:
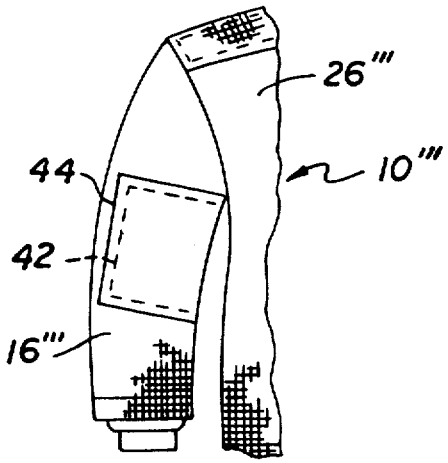
Figure 6:
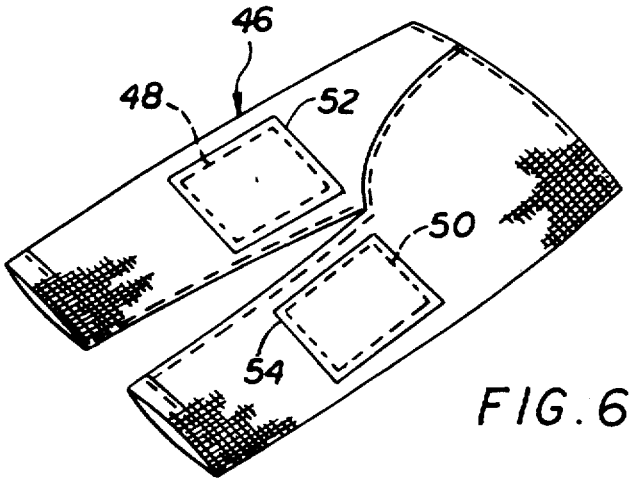

As shown in FIG. 4, pads 37, 38 are positioned on a garment 10" (which is constructed in accordance with the structure of. FIG. 3) in strategic locations, such as the elbow for pad 37 (and knee as shown in FIG. 6) and the shoulder yoke area for pad 38. Pads 37 and 38 are positioned between the outer shell 26' and the thermal liner 31 of the garment 10". Pad 38 is similar to pad 37 in that it is made of closed-cell foam material, but it also includes apertures to provide for moisture vapor transport from the wearer.

Figure 5:
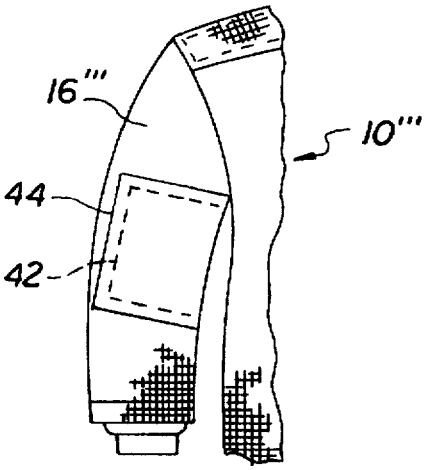
FIG. 5 is a detail of a garment similar to that in FIG. 1, but modified to include padding externally of the outer shell.

As shown in FIG. 5, with a garment 10''' constructed in accordance with FIGS. 1 and 2, in which the foam layer 32 is bonded to the outer shell 26, a pad 42 is placed on the exterior surface of the shell at the elbow on a sleeve 16''' and held in position by a leather patch 44. Such a pad 42, similar to pads 37 and 38, would provide increased thermal protection in these areas, as well as distribution of loads applied externally to these areas.

As shown in FIG. 6, similar construction can be applied to a pant 46, which would have the same ensemble construction as either of FIGS. 2 and 3. Furthermore, the knee portions of the pant 46 preferably would include pads 48, 50 of closed-cell foam material. Such pads 48, 50 could be either of the apertured or non-apertured variety. As shown in FIG. 6, the pads 48, 50 are mounted beneath patches 52, 54, respectively in the case where the pant 46 is constructed in accordance with FIG. 2. If the pant 46 is constructed in accordance with FIG. 3, it may be preferable to mount the pads 48, 50 beneath the exterior surface of the shell 26' as in FIG. 4. Again, such padding would provide increased thermal and compression resistance in the knee area.

While the forms of apparatus herein described constitute preferred embodiments of this invention, it is to be understood that the invention is not limited to these precise forms of apparatus, and that changes may be made therein without departing from the scope of the invention.

What is claimed is:

1. A method of constructing a relatively lightweight, low volume firefighter garment comprising the steps of:

providing an outer shell of an abrasion resistant and fire-retardant materials suitable for use in a firefighter garment;

providing a thermal liner having a layer of a closed-cell, cellular foam having a multiplicity of apertures therethrough, said foam being attached to a substrate, a combination of said substrate and foam being sufficiently fire retardant such that said combination resists melting, dripping or separating when exposed to a temperature of 500° F. for at least 5 minutes;

providing a moisture barrier layer having a semi-permeable membrane which allows the passage of moisture vapor therethrough but prevents the passage of liquid moisture therethrough; and assembling said thermal liner, moisture barrier layer and said outer shell by positioning said thermal liner within said outer shell and positioning said moisture barrier layer between said liner and a wearer of said garment, whereby said thermal liner and moisture barrier layer are positioned to permit flow of moisture vapor transport therethrough from a wearer of said garment to said outer shell.

2. The method of claim 1, further comprising the step of bonding said thermal liner to an inner surface of said outer shell.

3. The method of claim 2 wherein said bonding step includes the step of providing a multiplicity of dots of adhesive between said thermal liner and said inner surface of said outer shell.

4. The method of claim 1 further comprising the steps of making said substrate of a fire-retardant material; and bonding said foam layer to said substrate.

5. A protective firefighter garment comprising:

an outer shell made of an abrasion-resistant, flame and heat resistant material suitable for use in a firefighter garment; and a thermal liner layer positioned within said outer shell and made of an apertured, closed-cell, cellular foam which resists absorbing liquid moisture, said apertures allowing passage of moisture vapor outwardly from a wearer of said garment through said liner, said cellular foam being attached to a substrate, a combination of said substrate and foam being sufficiently fire retardant such that said combination resists melting, dripping or separating when exposed to a temperature of 500° F. for at least 5 minutes.

6. The garment of claim 5 further comprising a layer of moisture barrier material adjacent to said liner.

7. The garment of claim 6 wherein said moisture barrier layer includes a semi-permeable membrane which allows the passage of moisture vapor therethrough but prevents the passage of liquid moisture therethrough.

8. The garment of claim 7 wherein said liner is positioned adjacent to said shell; and said moisture barrier layer is positioned between said liner and a wearer of said garment.

9. The garment of claim 8 wherein said liner is attached to an inner surface of said outer shell.

10. The garment of claim 9 wherein said liner is bonded to an interior surface of said shell by an adhesive.

11. The garment of claim 8 wherein said substrate is made of a fabric material and is bonded to said layer of foam material.

12. The garment of claim 5 wherein said liner extends substantially throughout said garment and said layer of foam material is formed with a multiplicity of said apertures, said apertures being sized to allow moisture vapor generated by a wearer of said garment to pass through said liner.

13. The garment of claim 5 wherein said layer of foam material is between about 3/32 inches (2.38 mm) and 1/8 inches (3.18 mm) thick.

14. The garment of claim 5 wherein said apertures each are about 1 mm in diameter.

15. The garment of claim 5 further comprising a plurality of dots of adhesive; and wherein said liner is attached to an inner surface of said shell by said dots.

16. The garment of claim 15 wherein said dots each are approximately 1 mm in diameter.

17. The protective garment of claim 5 wherein said shell is made of an aramid fiber material.

18. A firefighter garment comprising:

an outer shell made of an abrasion-resistant, flame and heat resistant aramid fiber material suitable for use in a firefighter garment;

a thermal liner layer made of an apertured, closed-cell, cellular foam material which resists absorbing liquid moisture, said material being attached to a substrate, a combination of said substrate and foam being sufficiently fire retardant such that said combination resists melting, dripping or separating when exposed to a temperature of 500° F. for at least 5 minutes; and a moisture barrier positioned in said garment within said outer shell and having a semi-permeable membrane layer which is permeable to moisture vapor but not liquid moisture and a substrate, said thermal liner layer being positioned between said moisture barrier and said outer shell, whereby said thermal liner does not obstruct transport of moisture vapor outwardly from a wearer of said garment through said moisture barrier layer.

19. A firefighter garment comprising:

an outer shell made of an abrasion-resistant, fire retardant material;

a thermal liner layer positioned within said outer shell and made of an apertured, closed-cell, cellular foam which resists absorbing liquid moisture, said material being attached to a substrate, a combination of said substrate and foam being sufficiently fire retardant such that said combination resists melting, dripping or separating when exposed to a temperature of 500° F. for at least 5 minutes; and a moisture barrier layer positioned in said garment within said outer shell and having a semi-permeable membrane which is permeable to moisture vapor but not liquid moisture and a substrate.

20. A method of constructing a relatively lightweight, low volume firefighter garment comprising the steps of:

providing an outer shell of an abrasion resistant and fire-retardant materials suitable for use in a firefighter garment;

providing a thermal liner having a layer of a closed-cell, cellular foam having a multiplicity of apertures therethrough;

providing a moisture barrier layer having a semi-permeable membrane which allows the passage of moisture vapor therethrough but prevents the passage of liquid moisture therethrough;

assembling said thermal liner, moisture barrier layer and said outer shell by positioning said thermal liner within said outer shell and positioning said moisture barrier layer between said liner and a wearer of said garment, whereby said thermal liner and moisture barrier layer are positioned to permit flow of moisture vapor transport therethrough from a wearer of said garment to said outer shell; and providing a substrate of a fire-retardant material and bonding said foam layer to said substrate.

21. A protective firefighter garment comprising:

an outer shell made of an abrasion-resistant, flame and heat resistant material suitable for use in a firefighter garment;

a thermal liner layer positioned within and adjacent to said outer shell and made of an apertured, closed-cell, cellular foam which resists absorbing liquid moisture, said apertures allowing passage of moisture vapor outwardly from a wearer of said garment through said liner, said cellular foam being a material sufficiently fire and heat resistant to be used in the firefighter garment, said liner including a substrate of fabric material bonded to said foam material; and a layer of moisture barrier material positioned adjacent to said thermal liner layer and between said thermal liner layer and a wearer of said garment, wherein said moisture barrier layer includes a semi-permeable membrane which allows the passage of moisture vapor therethrough but prevents the passage of liquid moisture therethrough.

22. A relatively light weight, relatively thin protective garment providing protection from high ambient temperatures comprising:

an outer shell of an aramid fiber material;

a thermal liner having a layer of apertured, fire-retardant closed-cell foam material, said layer of foam material being between about 3/32 (2.38 mm) inches and 1/8 (3.18 mm) inches thick and having a multiplicity of apertures therethrough, said apertures having a density of about 84 of said apertures per square inch, each aperture being about 1 mm in diameter;

a plurality of adhesive dots for bonding said thermal liner to an inner surface of said outer shell; and a moisture barrier layer positioned in said garment within said thermal liner and having a semi-permeable membrane layer which is permeable to moisture vapor and a substrate made of a woven aramid fiber and bonded to said membrane, said moisture barrier being oriented within said garment such that said substrate faces a wearer of said garment;

whereby transport of moisture vapor from a wearer of said garment through said moisture barrier layer is not impeded by said thermal liner, and said apertures promote flow of moisture vapor outwardly from said moisture barrier layer.

23. A relatively lightweight, relatively thin protective garment providing protection from high ambient temperatures comprising:

an outer shell of an aramid fiber material;

a thermal liner having a layer of apertured, fire-retardant closed-cell foam material, said layer of foam material being between about 3/32 (2.38 mm) inches and 1/8 (3.18 mm) inches thick and having a multiplicity of apertures therethrough, said apertures having a density of about 84 of said apertures per square inch, each aperture being about 1 mm in diameter said thermal liner being adhesively attached to said outer shell;

a moisture barrier layer positioned in said garment within said thermal liner and having a semi-permeable membrane layer which is permeable to moisture vapor and a substrate made of a woven aramid fiber and bonded to said membrane, said moisture barrier being oriented within said garment such that said substrate faces a wearer of said garment;

whereby transport of moisture vapor from a wearer of said garment through said moisture barrier layer is not impeded by said thermal liner, and said apertures promote flow of moisture vapor outwardly from said moisture barrier layer.

* * * * *

UNITED STATES PATENT AND TRADEMARK OFFICE

CERTIFICATE OF CORRECTION

PATENT NO. : 5,697,101

DATED : December 16, 1997

INVENTOR(S) : Aldridge

It is certified that error appears in the above-identified patent and that said Letters Patent is hereby corrected as shown below:

The title page, showing an illustrative figure, should be deleted and substitute therefor the attached title page.

Delete drawing sheets 1 and 2 and substitute therefor the drawing sheets, consisting of Figs 1-6, as shown on the attached pages.

Signed and Sealed this

Fourteenth Day of April, 1998

Bruce Lehman

*Attest:*

BRUCE LEHMAN

*Attesting Officer*

*Commissioner of Patents and Trademarks*

United States Patent [19]

Aldridge

[11] Patent Number: 5,697,101

[45] Date of Patent: Dec. 16, 1997

[54] PROTECTIVE GARMENT WITH APERTURED CLOSED-CELL FOAM LINER

[75] Inventor: Donald Aldridge, New Carlisle, Ohio

[73] Assignee: Lion Apparel, Inc., Dayton, Ohio

[21] Appl. No.: 596,702

[22] Filed: Feb. 5, 1996

Related U.S. Application Data

[63] Continuation of Ser. No. 119,474, Sep. 10, 1993, abandoned.

[51] Int. Cl.[6] ..... A41D 13/00

[52] U.S. Cl. ..... 2/81; 2/97; 2/458

[58] Field of Search ..... 2/2, 2.11, 2.14, 2/2.15, 2.16, 69, 79, 81, 82, 85, 86, 87, 93, 97, 159, 161.6, 164, 272, 227, 5, 458

[56] References Cited

U.S. PATENT DOCUMENTS

| | | | |
|---|---|---|---|
| 2,570,182 | 10/1951 | Daly et al. | 260/2.5 |
| 2,976,539 | 3/1961 | Brown | 2/2 |
| 2,981,954 | 5/1961 | Garbellano | 2/2.1 |
| 4,034,417 | 7/1977 | Ellis | 2/81 |
| 4,495,661 | 1/1985 | Kamat | 2/97 |
| 4,502,153 | 3/1985 | Lapedes et al. | 2/81 |
| 4,583,247 | 4/1986 | Fingerhut et al. | 2/69 |
| 4,604,759 | 8/1986 | Bowman et al. | 2/81 |
| 4,685,155 | 8/1987 | Fingerhut et al. | 2/81 |
| 4,805,244 | 2/1989 | Scott | 2/272 |
| 4,843,646 | 7/1989 | Grilliot et al. | 2/69 |
| 4,860,382 | 8/1989 | Markwell | 2/82 |
| 4,922,552 | 5/1990 | Grilliot et al. | 2/93 |
| 4,994,317 | 2/1991 | Dugan et al. | 428/246 |
| 4,999,850 | 3/1991 | Grilliot et al. | 2/97 |
| 5,001,781 | 3/1991 | Grilliot et al. | 2/69 |
| 5,021,280 | 6/1991 | Farnworth et al. | 428/102 |
| 5,044,031 | 9/1991 | Sherwood et al. | 5/481 |
| 5,054,125 | 10/1991 | Snedeker | 2/81 |
| 5,136,723 | 8/1992 | Aldridge et al. | 2/81 |

OTHER PUBLICATIONS

Mustang Industries Marine Wear Brochure, 1986.
Product Information, Mustang Aviation Coverall, 1983.
Mustang Manufacturing Inc. Aviation Coverall, 1992.
Patagonia, Inc. Impact Tights, 1993.

*Primary Examiner*—Diana Biefeld
*Attorney, Agent, or Firm*—Thompson Hine & Flory LLP

[57] ABSTRACT

A protective garment having an outer shell and a thermal liner having a layer of apertured, closed-cell foam material. In a preferred embodiment, the foam material is fire retardant and the layer is bonded to the outer shell, and the garment includes a moisture barrier layer positioned between the foam liner and the wearer of the garment. The closed-cell foam liner is non-moisture absorbent and provides high thermal insulation for its weight and thickness in comparison to prior art thermal liners, so that a relatively thin layer of foam material may be used. Accordingly, the overall weight of the garment is minimized, as is the movement-restricting effect of the liner. The non-absorbency of the foam liner allows the liner to be positioned between the moisture barrier and the outer shell of the garment so that the liner does not restrict flow of perspiration moisture vapor from the wearer to the moisture barrier. The apertures formed in the foam liner promote transport through the liner of moisture vapor from the wearer which passes through the moisture barrier. Such closed-cell foam material may be used both as a continuous thermal barrier extending throughout the garment and/or in selected areas which require additional padding or thermal resistance.

23 Claims, 2 Drawing Sheets

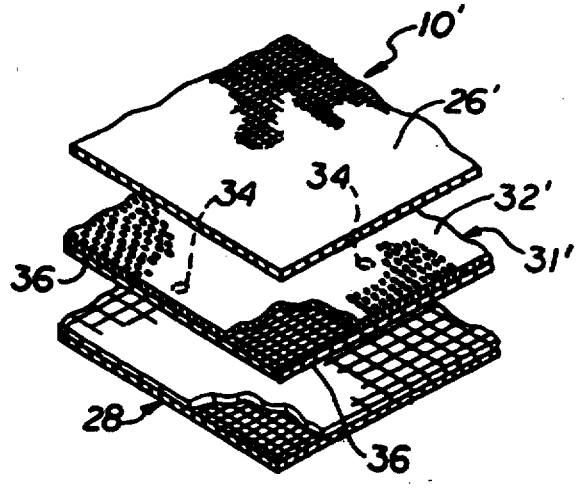

FIG. 3